US008316585B2

(12) United States Patent
Brochu

(10) Patent No.: US 8,316,585 B2
(45) Date of Patent: Nov. 27, 2012

(54) FLEXIBLE GUTTER SHIELD

(76) Inventor: Stephane Brochu, St-Romuald (CA)

( * ) Notice: Subject to any disclaimer, the term of this patent is extended or adjusted under 35 U.S.C. 154(b) by 0 days.

(21) Appl. No.: 12/931,781

(22) Filed: Feb. 9, 2011

(65) Prior Publication Data

US 2012/0151849 A1 Jun. 21, 2012

(30) Foreign Application Priority Data

Dec. 20, 2010 (CA) ..... 2726047

(51) Int. Cl.
*E04D 13/00* (2006.01)
*E04D 13/08* (2006.01)

(52) U.S. Cl. ..... 52/11; 52/12; 52/13; 52/14; 52/15; 52/16

(58) Field of Classification Search ..... 52/11–16
See application file for complete search history.

(56) References Cited

U.S. PATENT DOCUMENTS 3,630,383 A * 12/1971 Reeves ..... 210/404
4,905,427 A * 3/1990 McPhalen ..... 52/12
4,965,969 A * 10/1990 Antenen ..... 52/12
5,044,581 A * 9/1991 Dressler ..... 248/48.1
5,095,666 A * 3/1992 Williams, Jr. ..... 52/11
5,103,601 A * 4/1992 Hunt ..... 52/12
5,109,640 A * 5/1992 Creson ..... 52/12
5,459,965 A * 10/1995 Meckstroth ..... 52/12
5,522,183 A * 6/1996 Allen ..... 52/12
5,595,027 A * 1/1997 Vail ..... 52/12
5,617,678 A * 4/1997 Morandin et al. ..... 52/11
5,791,091 A * 8/1998 Barbera ..... 52/12
5,842,311 A * 12/1998 Morin ..... 52/12
6,134,843 A * 10/2000 Tregear ..... 52/12
6,594,956 B1 * 7/2003 Willing ..... 52/11
6,786,008 B2 * 9/2004 Brochu ..... 52/12
7,614,185 B2 * 11/2009 Brochu ..... 52/11
7,624,541 B2 * 12/2009 Gentry ..... 52/12
7,730,672 B2 * 6/2010 Knudson et al. ..... 52/12
7,752,812 B2 * 7/2010 Knudson et al. ..... 52/12
8,001,729 B2 * 8/2011 Joly et al. ..... 52/12

* cited by examiner

*Primary Examiner* — Mark Wendell
(74) *Attorney, Agent, or Firm* — Eric Fincham

(57) ABSTRACT

A gutter cover having a foraminous central portion with a first side structure and a second side structure, the first side structure having an upwardly extending wall portion, a downwardly extending wall portion merging with the upwardly extending wall portion, and a flange portion extending outwardly from the downwardly extending wall portion, the second side structure having an upwardly extending portion and a flange arrangement associated with the second side structure, the foraminous central portion being formed of a flexible material to permit the central portion to bend to permit placement of the gutter cover in position.

8 Claims, 3 Drawing Sheets

FLEXIBLE GUTTER SHIELD

FIELD OF THE INVENTION

The present invention relates to an eavestrough or gutter assembly and more particularly, relates to improvements to such structures.

BACKGROUND OF THE INVENTION

The use of shields with gutters or eavestroughs is well known in the prior art and there have been many proposals for different types of shields. The purpose of the shield is essentially to permit passage of rainwater from the roof to the eavestrough while protecting the same from extraneous foreign matter such as leaves and the like.

To date, there have been many different approaches taken. A first approach is utilizing a shield or a guard which is apertured and permits the passage of rainwater while extensively barring the passage of extraneous material. However, many of these guards do function as desired and access must still be had to the eavestrough for cleaning purposes.

It is also being proposed in the art to provide relatively complex structures wherein eavestroughs are mounted for rotatable movement such that they may be emptied at desired intervals. It is also being proposed that the cover have an outer edge which flows downwardly and the water flow follows the curved portion due to surface tension and thereafter cascades into the eavestrough. However, when the volume of water becomes sufficiently large, the surface tension is insufficient to cause all the water to flow into the eavestrough.

SUMMARY OF THE INVENTION

It is an object of the present invention to provide a novel gutter guard which is adapted to be used with existing gutters and which will eliminate the use of attachment members for securing the gutter guard to the gutter or eavestrough.

The device of the present invention may be formed of any suitable material and could conveniently be formed of a metallic or a plastic material. The gutter guard will be flexible for reasons which will become apparent hereinbelow and accordingly, a suitable material and thickness thereof can be selected by those knowledgeable in the art.

The device of the present invention provides a guard for the eavestrough to prevent foreign matter from entering the eavestrough. The appropriate sizing of the apertures is required and again, the teachings of the art are many. One such teaching is contained in U.S. Pat. No. 6,786,008 issued Sep. 7, 2004, the teachings of which are hereby incorporated by reference.

According to one aspect of the present invention there is provided a gutter cover comprising a foraminous central portion having a first side structure and a second side structure, the first side structure being designed to be retained adjacent a rear wall of an eavestrough, the second side structure having an upwardly extending portion, a flange arrangement associated with the second side structure, the foraminous central portion being formed of a flexible material to permit the central portion to bend to thereby permit placement of the gutter cover in position.

According to a further aspect of the present invention there is also provided in combination, an eavestrough and a gutter cover therefore, the eavestrough comprising a rear wall, a bottom wall, a front wall, the front wall terminating in a substantially vertical upper front wall portion, a top wall portion and a flange extending from the top wall towards the upper front wall to define a recess therein, the gutter cover comprising a foraminous central portion having a first side structure and a second side structure, the first side structure having an upwardly extending wall portion, a downwardly extending wall portion merging with the upwardly extending wall portion, a flange portion extending outwardly from the downwardly extending wall portion, the second side structure having an upwardly extending portion, a flange arrangement associated with the second side structure, the foraminous central portion being formed of a flexible material to permit the first central portion to bend to thereby permit placement of the gutter cover in position.

BRIEF DESCRIPTION OF THE DRAWINGS

Having thus generally described the invention, reference will be made to the accompanying drawings illustrating embodiments thereof, in which.

DETAILED DESCRIPTION OF THE INVENTION

Figure 1:
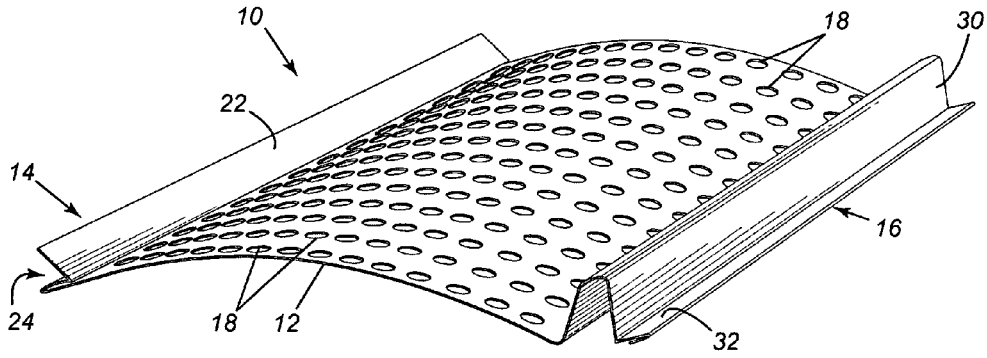
FIG. 1 is a perspective view of a gutter cover according to one embodiment of the present invention.
Figure 2:
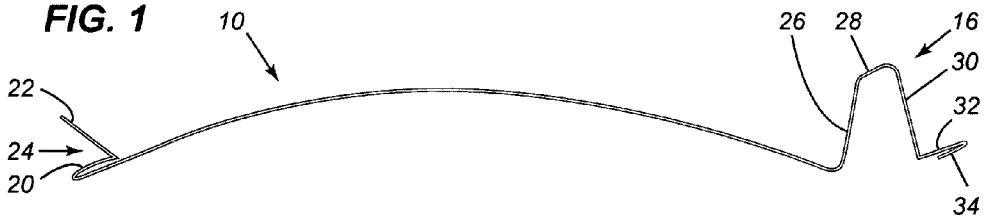
FIG. 2 is a side elevational view thereof.

Referring to the drawings in greater detail and by reference characters thereto, there is illustrated in FIGS. 1 and 2 a gutter cover which is generally designated by reference numeral 10.

Gutter cover 10 includes a central portion 12 with a first side structure generally designated by reference numeral 14 and a second side structure generally designated by reference numeral 16. As may be seen in FIG. 1, a plurality of apertures 18 are formed in central portion 12 to permit drainage of water therethrough. It will also be noted that central portion 12 is formed to have a slightly convex configuration. A curvature in the area of 5½ inches has been found to be suitable for this embodiment.

First side structure 14 includes a first segment 20 which extends upwardly and inwardly and which merges with an upwardly and outwardly extending segment 22. Segments 20 and 22 define therebetween a V-shaped recess 24.

Second side structure 16 includes an upwardly extending wall 26 adjacent central portion 12. Inwardly extending wall 26 merges with a top wall 28 which in turn forms a downwardly extending wall 30. An outwardly extending flange 32 has a reverse segment 34 folded thereunder.

Figure 7:
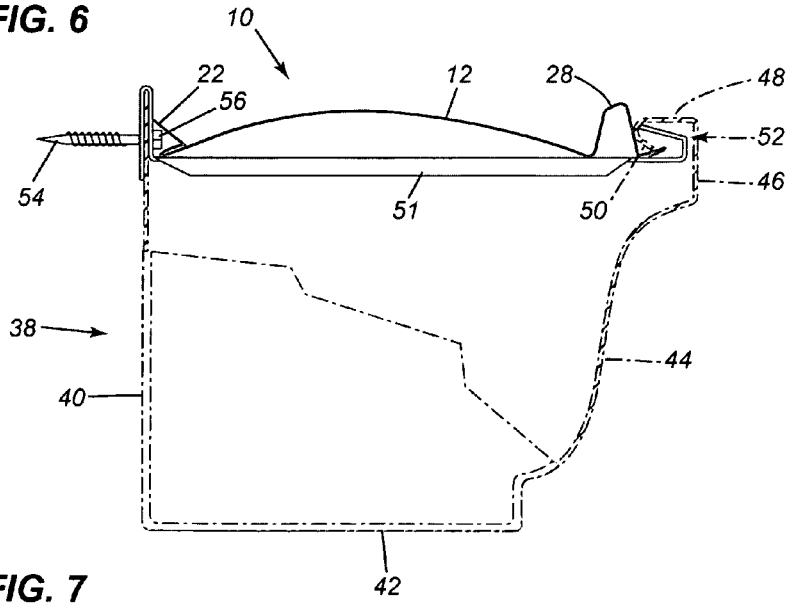
FIG. 7 is a side elevational view illustrating the gutter cover of FIG. 1 secured to an eavestrough.

The use of gutter cover 12 is illustrated in FIG. 7 and reference will now be had thereto. A gutter or eavestrough 38 is of a conventional K-type formation and includes a rear wall 40, a bottom wall 42 and a front wall 44. Located at the top of front wall 44 is an upper front wall 46 which merges with a top wall 48 and then an inwardly extending flange 50 is formed. Upper front wall 46, top wall 48 and inward flange 50 define therebetween a recess 52. As may be seen in FIG. 7, the gutter is attached to a wall by a hanger 51 with a screw 54 having a head 56. The screw head 56 seats within recess 24 to secure first side structure 14 while flanges 32 and 34 fit within recess 52.

Second side structure 16 utilizes flange 32 to fit within recess 52 to thereby retain this side of the gutter cover in position.

The curvature of central portion 12 assists in the bending thereof to allow insertion of the side structures to their locking position. As aforementioned, the gutter cover 10 is formed of a sufficiently flexible material to permit such bending.

Figure 5:
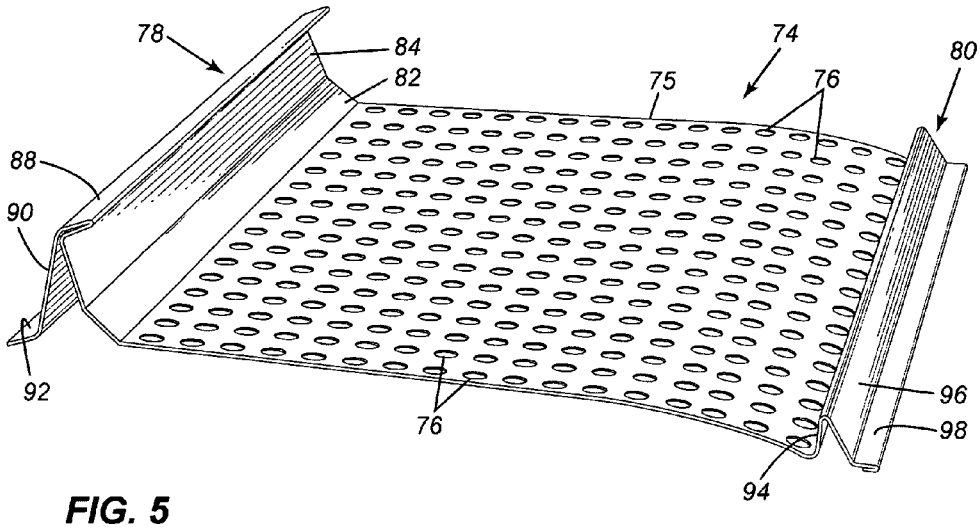
FIG. 5 is a perspective view of a further embodiment of a gutter cover according to the present invention.
Figure 6:
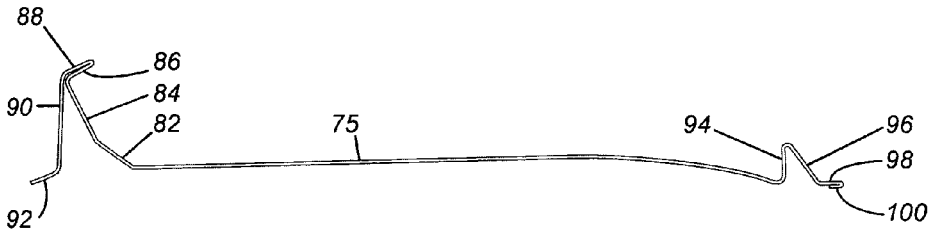
FIG. 6 is a side elevational view thereof.

A second embodiment of a gutter cover is shown in FIGS. 5 and 6 and will now be referred to. Gutter cover 74 has a central portion 75 with apertures 76 formed therein. Gutter cover 74 also has a first side structure 78 and a second side structure 80. First side structure 78 includes a first upwardly and outwardly extending segment 82 which merges with a second upwardly and outwardly extending segment 84. Merging with second segment 84 is an inwardly extending segment 86 which in turn merges with a top wall segment 88. A downwardly extending wall segment 90 terminates in a flange 92.

Second side wall structure 80 includes a substantially vertical wall 94 which merges with a downwardly and outwardly segment 96. The wall structure terminates with a substantially horizontal flange 98 and a reverse segment 100.

Figure 8:
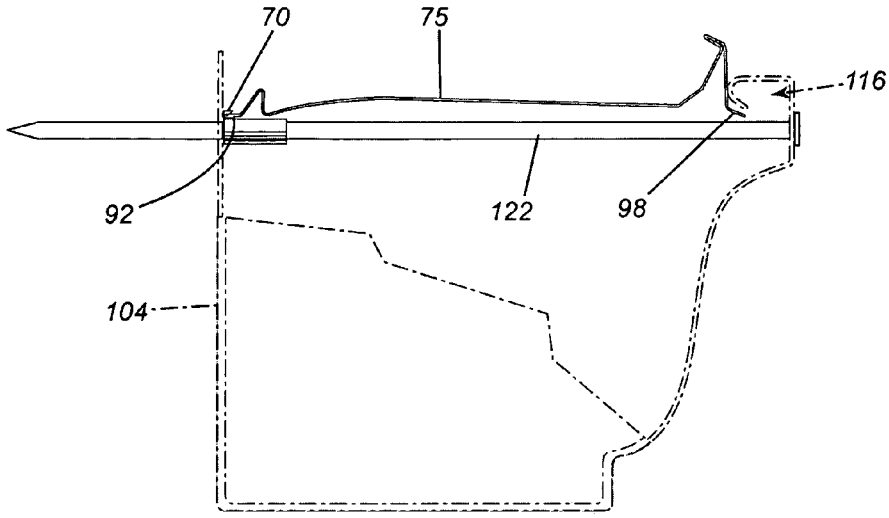
FIG. 8 is a side elevational view of the gutter cover of FIG. 5 secured to an eavestrough when nails are utilized to attach the eavestrough to a building.
Figure 9:
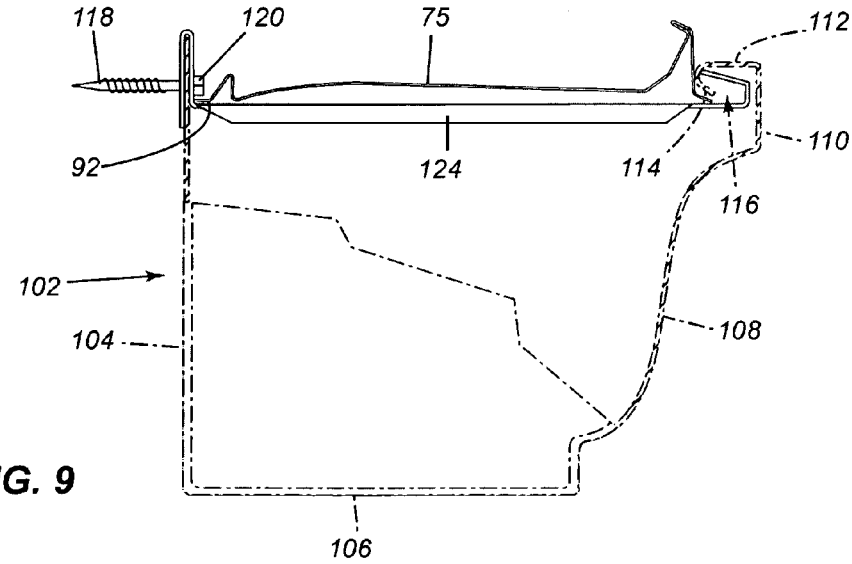
FIG. 9 is a side elevational of the gutter cover of FIG. 5 secured in place on a gutter when screws are utilized to attach the eavestrough to a building.

Gutter cover 74 is illustrated in an installed position in FIGS. 8 and 9. Thus, an eavestrough 102 is comprised of a rear wall 104, a bottom wall 106 and a front wall 108. At the top of front wall 108, there is provided an upper front wall 110, a top wall 112 and an inwardly extending flange 114 which together define a recess 116.

In FIG. 9, the gutter is attached to the main structure by means of screws 118 having a head 120. As may be seen, flange 98 and reverse segment 100 are retained under the head 120 of screw 118 while at the opposite side, flange 92 is retained within recess 116. A conventional hanger 124 is utilized in conjunction with screw 118.

Figure 3:
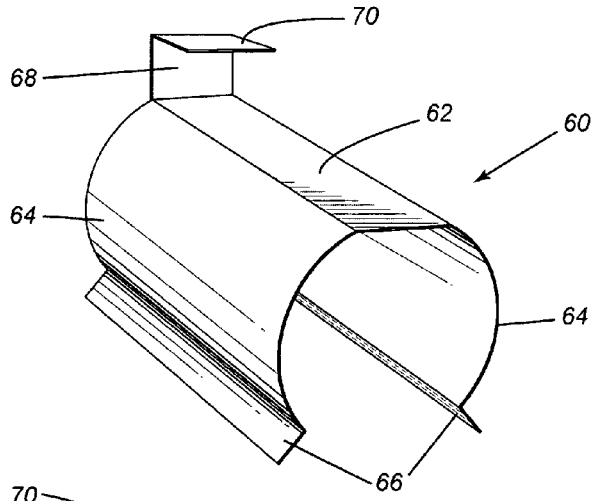
FIG. 3 is a perspective view of an adaptor used in conjunction with the gutter cover when nails are used for attaching the gutter to a building.
Figure 4:
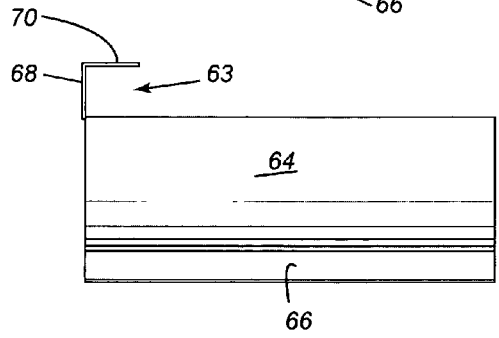
FIG. 4 is a side elevational view thereof.

For those gutters which are nailed in position, as shown in the embodiment of FIG. 8, an adaptor 60 may be utilized. Adaptor 60, as seen in FIGS. 2 and 3, has a planar top wall 62 and arcuate side walls 64 extending downwardly therefrom. Side walls 64 finish in base flanges 66. At one end of top wall 62, there is provided an upwardly extending segment 68 and a horizontal top segment 70. As shown in FIG. 8, flange 92 fits within the recess 63 defined by upward segment 68 and horizontal segment 70. Adaptor 60 is utilized in conjunction with a nail 122 as shown in FIG. 8.

In both the embodiments of FIGS. 8 and 9, flange 98 fits within recess 116 to hold second side structure 80 in position. Again, the central portion 75 is flexible and as may be seen in the drawings, central portion 75 has arcuate portions at either side to permit easy flexing for insertion in position.

It will be understood that the above described embodiment is for purposes of illustration only and that changes and modifications may be made thereto without departing from the spirit and scope of the invention.

I claim:

1. A gutter cover comprising:

a foraminous central portion having a first side structure and a second side structure;

said first side structure being designed to be retained adjacent a rear wall of an eavestrough;

said second side structure having an upwardly extending portion, said upwardly extending portion extending higher than said foraminous central portion when said gutter cover is in position on said eavestrough, a flange arrangement associated with said second side structure;

said foraminous central portion being formed of a flexible material to permit said central portion to bend to thereby permit placement of said gutter cover in position.

2. The gutter cover of claim 1 wherein said central portion has a convex configuration.

3. The gutter cover of claim 1 wherein said first side structure has a first segment extending inwardly and a second segment extending outwardly to define therebetween a V-shaped recess.

4. The gutter cover of claim 1 wherein said second side structure has an upwardly extending wall, said second side structure terminating in an outwardly extending flange.

5. The gutter cover of claim 1 wherein each of said first side structure and said second side structure terminate in a flange.

6. In combination, an eavestrough and a gutter cover therefore, said eavestrough comprising:

a rear wall, a bottom wall, a front wall, said front wall terminating in a substantially vertical upper front wall portion, a top wall portion and a flange extending from said top wall towards said upper front wall to define a recess therein, said eavestrough being secured to a building by means of a hanger with a screw having a head;

said gutter cover comprising:

a foraminous central portion having a first side structure and a second side structure;

said first side structure having an upwardly extending wall portion, a downwardly extending wall portion merging with said upwardly extending wall portion, a flange portion extending outwardly from said downwardly extending wall portion, said first side structure having a first segment extending inwardly and a second segment extending outwardly to define therebetween a V-shaped recess, said head of said screw fitting within said V-shaped recess to thereby retain said first side structure in position;

said second side structure having an upwardly extending portion, a flange arrangement associated with said second side structure;

said foraminous central portion being formed of a flexible material to permit said first central portion to bend to thereby permit placement of said gutter cover in position.

7. The combination of claim 6 wherein said flange arrangement of said second side structure fits within said recess of said eavestrough.

8. The combination of claim 6 wherein said eavestrough is secured to a building by means of a nail, an adaptor at least partially encircling said nail, said first side structure terminating in a first side structure flange, said first structure flange being retained in position by said adaptor.

* * * * *